US007273187B2

(12) United States Patent
Kjeldal et al.

(10) Patent No.: US 7,273,187 B2
(45) Date of Patent: Sep. 25, 2007

(54) NOZZLE FOR AIR-ASSISTED ATOMIZATION OF A LIQUID FUEL

(75) Inventors: Bent Kjeldal, Soenderborg (DK); Ove Steen Boe, Aabenraa (DK)

(73) Assignee: Danfoss A/S, Nordborg (DK)

( * ) Notice: Subject to any disclaimer, the term of this patent is extended or adjusted under 35 U.S.C. 154(b) by 34 days.

(21) Appl. No.: 10/570,218

(22) PCT Filed: Aug. 26, 2004

(86) PCT No.: PCT/DK2004/000565

§ 371 (c)(1),
(2), (4) Date: Feb. 28, 2006

(87) PCT Pub. No.: WO2005/022036

PCT Pub. Date: Mar. 10, 2005

(65) Prior Publication Data

US 2007/0001029 A1 Jan. 4, 2007

(30) Foreign Application Priority Data

Sep. 1, 2003 (DK) ..... 2003 01234

(51) Int. Cl.
*B05B 7/10* (2006.01)

(52) U.S. Cl. ..... 239/112; 239/106; 239/113; 239/290; 239/403; 239/405; 239/422; 239/424; 239/433; 239/475; 239/490; 239/492; 239/493

(58) Field of Classification Search ..... 239/104, 239/106, 112, 113, 290, 291, 296, 422, 428, 239/433, 403, 404, 405, 406, 463, 475, 490–493
See application file for complete search history.

(56) References Cited

U.S. PATENT DOCUMENTS 2,539,315 A * 1/1951 Murphy ..... 239/424

(Continued)

FOREIGN PATENT DOCUMENTS

GB 699368 11/1953

(Continued)

*Primary Examiner*—Steven J. Ganey
(74) *Attorney, Agent, or Firm*—McCormick Paulding & Huber LLP

(57) ABSTRACT

A nozzle (100) for air-assisted atomizing of a liquid fuel comprises a fuel feed passage (110) and an air feed passage (114) and a swirling chamber (118) from which fuel and air may be passed to an exit orifice (126) for emerging a cone shaped spray. An air bypass passage (122) is provided for leading a fraction of the air flow in the air feed passage (114) past the swirling chamber (118) and to an air exit (124) arranged such with respect to the exit orifice (126) that, during operation of the nozzle, air emerging through the air exit (124) reduces depositing of residues of fuel on a downstream surface (130, 132, 136) of the nozzle element (108). Grooves or other flow-guiding elements may confer swirling or rotation of air in or downstream of the air feed passage (114) and/or the air bypass passage (122).

14 Claims, 4 Drawing Sheets

U.S. PATENT DOCUMENTS

| | | | | |
|---|---|---|---|---|
| 3,088,681 | A | 5/1963 | McCutcheon, Jr. | 239/427 |
| 3,310,240 | A | 3/1967 | Grundman | 239/404 |
| 3,684,186 | A * | 8/1972 | Helmrich | 239/403 |
| 3,979,069 | A | 9/1976 | Garofalo | 239/400 |
| 4,216,908 | A | 8/1980 | Sakurai et al. | 239/132.3 |
| 4,726,192 | A | 2/1988 | Willis et al. | 60/737 |
| 4,798,330 | A | 1/1989 | Mancini et al. | 239/8 |
| 5,833,141 | A * | 11/1998 | Bechtel et al. | 239/406 |
| 6,045,058 | A * | 4/2000 | Dobbeling et al. | 239/405 |
| 6,688,534 | B2 * | 2/2004 | Bretz | 239/403 |

FOREIGN PATENT DOCUMENTS

| | | |
|---|---|---|
| JP | 1033421 | 2/1989 |
| JP | 8200623 | 8/1996 |
| WO | 03/024611 A1 | 3/2003 |

* cited by examiner

NOZZLE FOR AIR-ASSISTED ATOMIZATION OF A LIQUID FUEL

CROSS REFERENCE TO RELATED APPLICATIONS

This application is entitled to the benefit of and incorporates by reference essential subject matter disclosed in International Patent Application No. PCT/DK2004/000565 filed on Aug. 26, 2004 and Danish Patent Application No. PA 2003 01234 filed Sep. 1, 2003.

FIELD OF THE INVENTION

The present invention generally relates to the field of nozzles for air-assisted atomization of a liquid fuel, more specifically to such nozzles, wherein a fuel feed passage and an air feed passage lead fuel and air to a swirling chamber in which atomization of the fuel is initiated, there being provided means downstream of the swirling chamber for emitting a spray of atomized fuel.

BACKGROUND OF THE INVENTION

Various spray nozzles of the abovementioned type have been proposed in the prior art. WO 03/024611 discloses a low pressure spray nozzle with an elongated nozzle body. There is provided an air swirling insert and, within an interior bore in the air swirling insert, a fluid distribution insert which has a radially inner set of circumferentially disposed air swirling vanes on an inwardly tapered exterior surface thereof. The air swirling insert also has a raidally outer set of circumferentially disposed air swirling vanes on an inwardly tapered exterior surface thereof. The latter air swirling vanes impart a rotational component of motion to low pressure air flowing between the exterior surface of the air swirling insert and a tapered wall portion of an interior chamber of the nozzle body. The air swirling vanes direct swirling air toward a downstream fluid mixing chamber to interact with sheared fluid drops exiting an upstream fluid mixing chamber of the air swirling insert. In the far downstream end of the nozzle body there is provided an outwardly tapered exit orifice through which a cone shaped spray distribution pattern is emitted.

BRIEF SUMMARY OF THE INVENTION

It is an object of preferred embodiments of the invention to provide a spray nozzle which may decrease the presence of hazardous components in exhaust gas emitted from a combustion appliance, such as a furnace, incorporating the nozzle.

Accordingly, the invention provides a nozzle for air-assisted atomization of a liquid fuel, the nozzle comprising a housing and, within the housing:

- a fuel feed passage and an air feed passage;
- a swirling chamber arranged at a downstream end of the fuel and air feed passage, respectively;
- an exit orifice downstream of the swirling chamber through which a cone shaped spray of fuel may emerge out of a nozzle element;
- an air bypass passage for leading a fraction of the air flow in the air feed passage past the swirling chamber and to at least one air exit, the at least one air exit being arranged such with respect to the exit orifice that, during operation of the nozzle, air emerging through the air exit reduces depositing of residues of fuel on a downstream surface of the nozzle element.

It has been found that, by reducing the depositing of residues of fuel on the downstream surface of the nozzle element, the presence of hazardous components in exhaust gas emitted from a combustion appliance, in which the nozzle is incorporated, has shown to decrease during start-up and shutdown of the combustion appliance.

There may be provided one single air exit and one or more air bypass passages, or, alternatively, a plurality of air exits of a single air bypass passage or of distinct air bypass passages. The location and shape of the air exit(s) and the air bypass passage(s) will usually depend from the layout of the exit orifice or the exit orifices, if more than one exit orifice is provided in the nozzle. In a preferred embodiment of the invention, the air exit is provided as an annular, i.e. ring-shaped orifice or opening for forming an air cushion or an air flow around the exit orifice for reducing depositing of fuel on the downstream surface of the nozzle element. Alternatively, a plurality of distinct air exits may be radially displaced relative to the exit orifice, with the distinct air exits being arranged so as to form a similar air cushion or air flow. The exit orifice is preferably provided centrally within the housing and/or the nozzle element. The cross-sectional shape of the air exit in a plane perpendicular to an axis of revolution of the housing or nozzle element may for example be circular, rectangular or arc-shaped. In case of only a single air exit being provided, such an air exit is preferably annular with an inner radius larger than an outer radius of the exit orifice. At least a part of the air bypass passage is preferably provided in the nozzle element, the nozzle element being either an integral part of the housing or a separate insert in the housing.

In one embodiment of the invention, an upstream portion of the air feed passage is provided as an annular passage extending along an outer surface of a core element of the nozzle, in which the fuel feed passage is provided as a central passage. The annular portion of the air feed passage may accordingly be formed by an inner surface of a bore or passage in the housing and an outer surface of the core element. In the core element there may be provided a plurality of inwardly extending passages forming part of the air feed passage. An upstream end surface of the nozzle element is preferably inwardly tapered. At the transition between the annular passage and the inwardly extending passages in the core element, an upstream portion of the air bypass passage may be formed as a gap between an outer circumferential surface of the nozzle element and an inner surface of the housing. The swirling chamber is preferably arranged centrally within the housing at a downstream end of the air and fuel feed passages.

The air exit is preferably arranged at a location downstream of the swirling chamber, so that the air exit may be focussed and directed toward that part of the downstream end surface of the nozzle element at which depositing of fuel residues is to be reduced. An inner circumferential surface at the downstream end of the housing may be outwardly tapered from the air exit to a far downstream end surface of the housing, or it may extend parallel to a longitudinal axis of the nozzle. A far downstream end portion of the housing may form an indentation in the downstream end surface of the nozzle, in which indentation a downstream surface of the nozzle element is exposed.

With the aim of achieving an efficient air flow downstream of the air exit, a rotating air flow may be generated by at least a portion of the air bypass passage being curved in a cross-sectional plane perpendicular to the axis of revolution. Alternatively, the rotating air flow may be generated by guide vanes or grooves. The direction of rotation of the air flow may be the same as the direction of rotation of the fuel exiting the swirling chamber, or it may be opposite to the rotation of the fuel exiting the swirling chamber. Depending upon operational characteristics, such as air and fuel flow rate and pressure, it may be desired that the air flow at the air exit(s) and downstream thereof is turbulent. A portion of the air bypass passage may be substantially parallel to the axis of revolution in a cross-sectional plane parallel to the axis of revolution.

An exit passage may be provided downstream of the swirling chamber, preferably as a central orifice in the nozzle element, for causing a controlled dispersing of the fuel, an upstream end of the exit passage being in fluid communication with the swirling chamber. The swirling chamber may extend into the exit passage. The exit orifice, i.e. the outlet of the exit passage, may be arranged downstream of the air exit(s) with the exit orifice being defined by a short tubular projecting portion at the downstream surface of the nozzle element. Tests have indicated that such a tubular projection has a beneficial effect in terms of reducing depositing of residues of fuel on the downstream end surface of the nozzle element. A planar portion of the end surface of the nozzle element may thereby be exposed upstream of the exit orifice, the air exit(s) being preferably arranged upstream of and preferably radially outwardly in relation to the exit orifice. In one embodiment, the exit orifice is located in a plane defined by a far downstream end surface of the housing.

The invention also relates to a method for reducing depositing of residues of fuel on a downstream surface of a nozzle element in a nozzle for air-assisted atomization of a liquid fuel, the nozzle comprising a housing and, within the housing:

a fuel feed passage and an air feed passage;

a swirling chamber arranged at a downstream end of the fuel and air feed passage, respectively;

an exit orifice downstream of the swirling chamber through which a cone shaped spray of fuel may emerge out of the nozzle element;

an air bypass passage for leading a fraction of the air flow in the air feed passage past the swirling chamber and to at least one air exit; the method comprising leading at least a part of the air emerging through the air exit past the downstream surface of the nozzle element.

It should be understood that any function and feature of the nozzle discussed herein also applies to the method of the invention.

The invention may be applied throughout a wide interval of fuel and air flow rates and pressures. A particular relevant field of usage is the low-pressure field, in which pressurized fluid fuel and pressurized air enter the nozzle at a relatively low operating pressure, e.g. 0.01-0.5 bar.

BRIEF DESCRIPTION OF THE DRAWINGS

A preferred embodiment of the invention will be further described with reference to the drawings, in which.

DETAILED DESCRIPTION OF THE INVENTION

Figure 1:
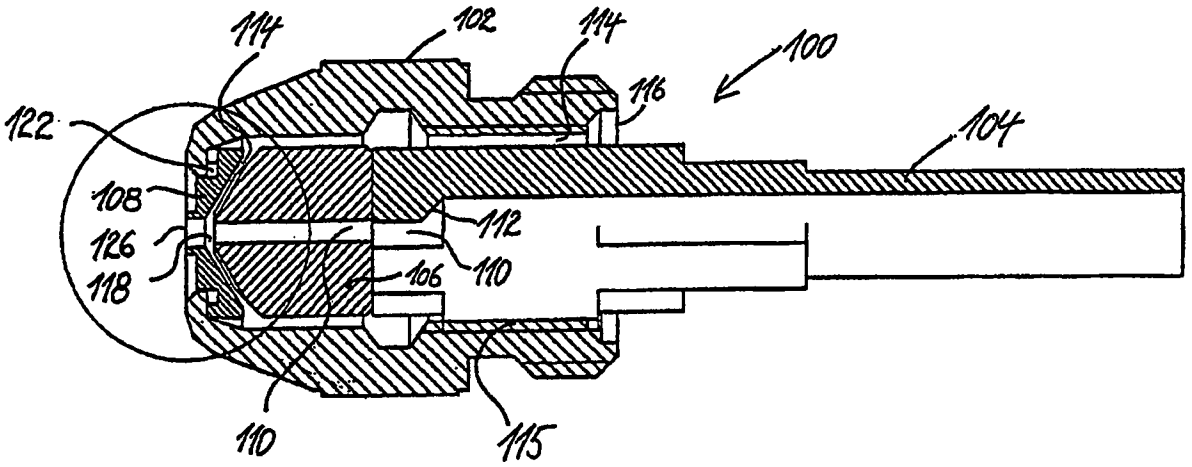
FIG. 1 shows a cross-sectional cut through an embodiment of a nozzle according to the invention.
Figure 2:
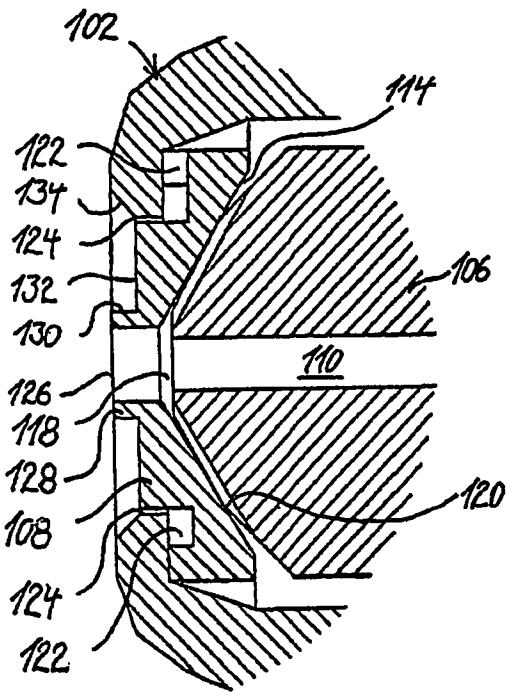
FIG. 2 shows an enlarged detail view of a downstream portion of the nozzle of FIG. 1.

A nozzle 100 as shown in FIG. 1 comprises a housing 102, a fuel supply member 104, a core element 106, and a nozzle element 108. A fuel feed passage 110 extends through the fuel supply member 104 and the core element, the fuel supply member defining an inwardly tapered portion 112 at a transition between a large diameter section of the fuel feed passage and a reduced diameter section thereof. An air feed passage 114 extends from an upstream end 116 of the housing 102 to a swirling chamber 118 arranged centrally within the housing in alignment with the fuel feed passage 110. An upstream portion of the air feed passage 114 is formed as three distinct grooves arranged along an outer circumferential surface of the fuel supply member 114, the grooves being provided in a threaded portion 115 of the fuel supply member. A downstream portion of the air feed passage 114 is formed as grooves 120 (see FIG. 2) in the core element, the grooves extending inwardly toward the swirling chamber 118. The grooves 120 provided in the core element 106 are shown more clearly in FIGS. 5 and 6. As shown in FIG. 1, the threaded portion 115 of the fuel supply member 104 engages a corresponding inner threaded portion of the housing, so that the fuel supply member 104 abuts and presses against the core element 106 which in turn abuts the nozzle element 108, the nozzle element 108 abutting an inner surface in an end wall or flange or the housing.

It has been found that during operation of the nozzle, residues of fuel tend to deposit at outer surfaces 130 and 132 of the nozzle element.

Accordingly, an air bypass passage 122 is provided for leading a fraction of air in the air feed passage past the swirling chamber 118 and to an air exit or slit 124. An exit orifice 126 for fuel is provided at a downstream end of a tubular projecting portion 128 of the nozzle element 108. It has been found that less residues of fuel tend to deposit at the downstream surfaces of the nozzle element 108 in embodiments with such a tubular projecting portion 128 than in embodiments in which the exit orifice 126 is provided as a simple bore in the nozzle element 108, i.e. embodiments in which the downstream surface of the nozzle element 108 is entirely planar. In order to efficiently prevent residues of fuel from being deposited at the outer surfaces 130 and 132 of the nozzle element during operation of the nozzle, the air exit 124 is arranged radially outwardly with respect to the tubular projecting portion 128 and the surfaces 130 and 132, and upstream thereof. An outwardly tapered portion 134 is provided at an inner circumferential surface at the far downstream end of the housing. In an alternative embodiment, the inner circumferential surface is parallel to the axis of revolution.

Figure 3:
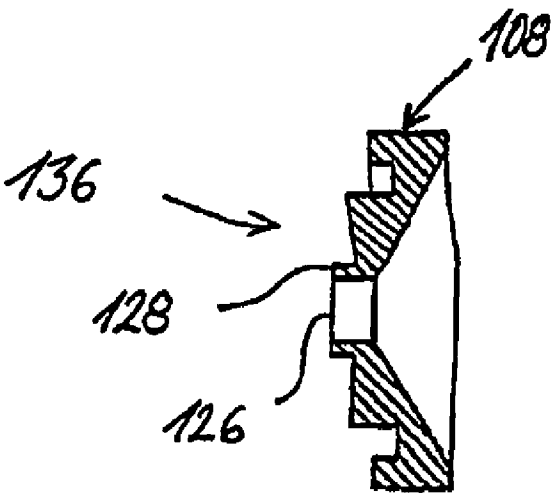
FIG. 3 shows a cross-sectional cut through a nozzle element comprised in the nozzle of FIGS. 1 and 2.
Figure 4:
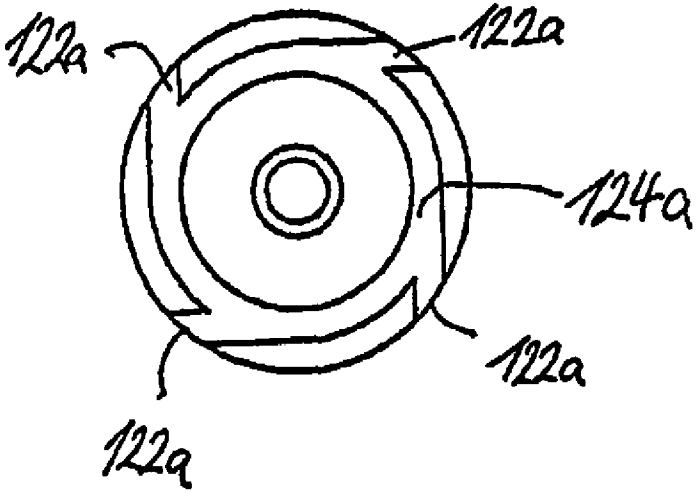
FIG. 4 shows an end view of the nozzle element of FIG. 3.

The nozzle element 108 is shown in detail in FIGS. 3 and 4. A groove 124*a* with a circular inner wall defines a border of the air bypass passage 122 and of the opening 124 when the nozzle element is mounted in the housing 102. At its outer circumferential surface, the groove 124*a* defines four transversely extending portions 122*a* which extend to an outer circumferential surface of the nozzle element, so as to thereby allow air to pass from the air feed passage 114 to the groove 124*a* when the nozzle element is mounted in the housing 102. Due to the circularity of the groove 124, the air flowing in the air bypass passage 122 when the nozzle is assembled and in operation rotates when it exits through the air exit 124.

Figure 5:
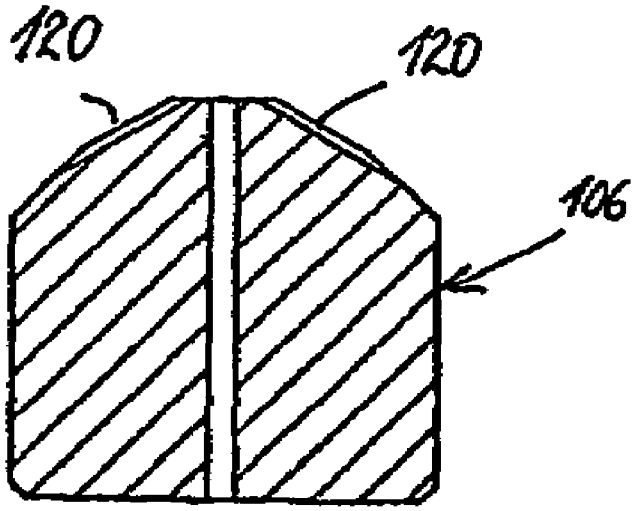
FIG. 5 shows a cross-sectional cut through a core element comprised in the nozzle of FIGS. 1 and 2.
Figure 6:
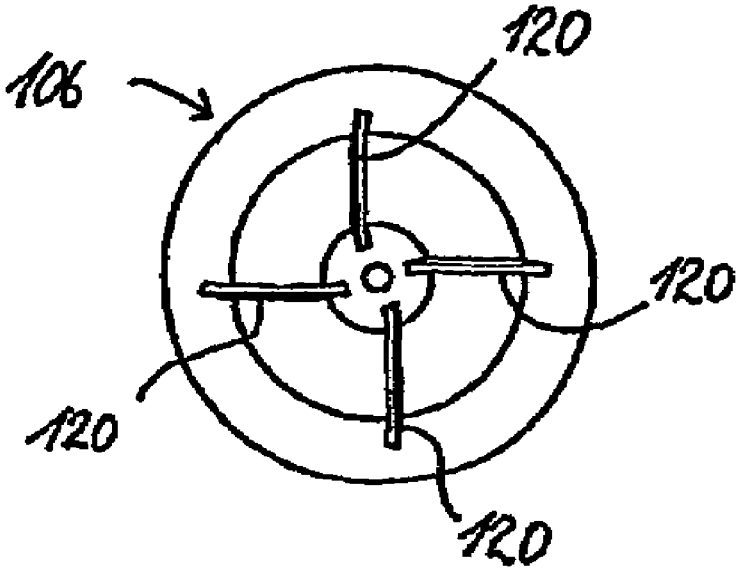
FIG. 6 shows a downstream end view of the core element of FIG. 5.

FIGS. 5 and 6 show an end view of the core element 106 with grooves 120, cf. above.

Figure 7:
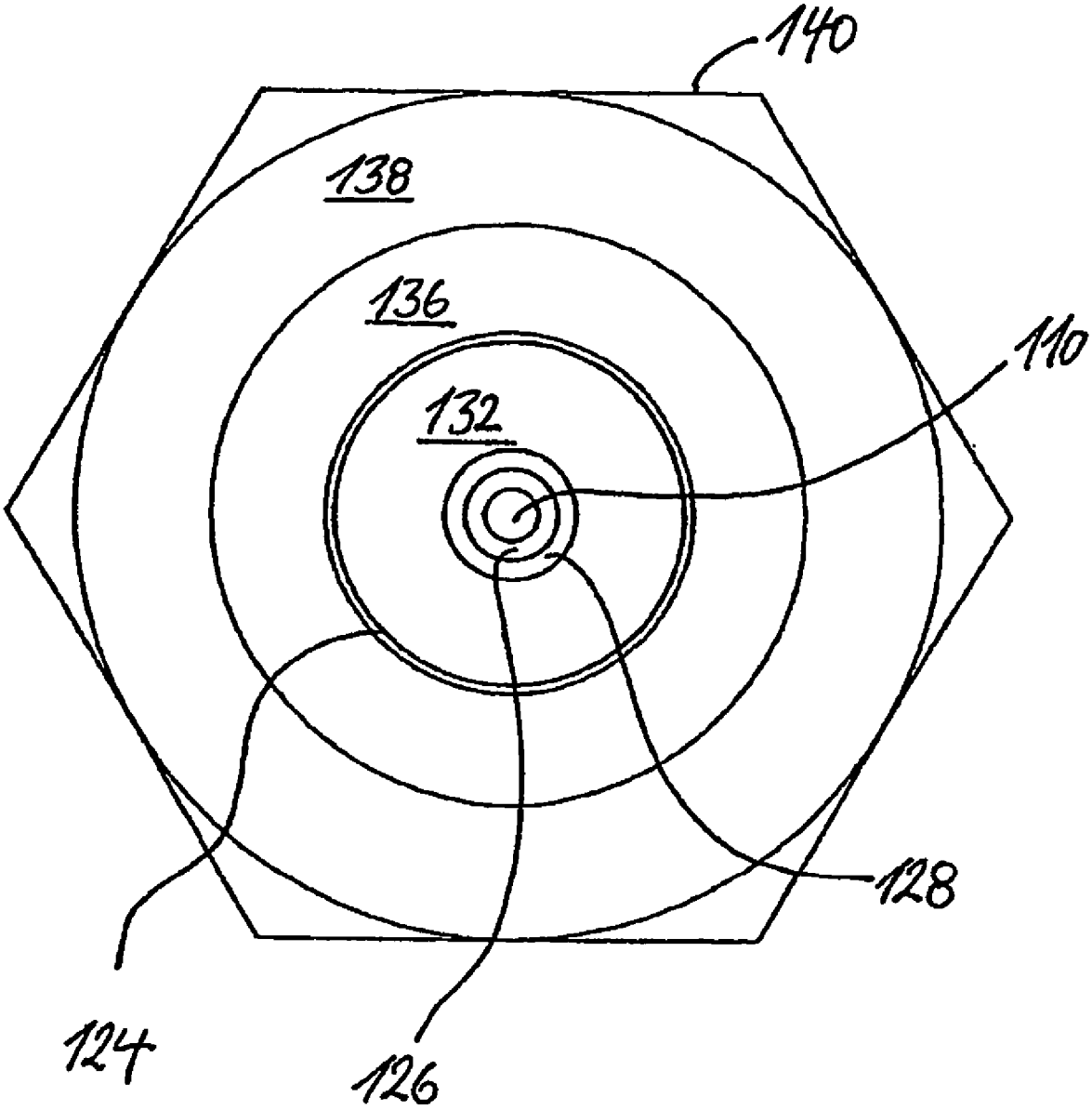
FIG. 7 shows a downstream end view of a second embodiment of a nozzle according to the invention.

A downstream end view of a second embodiment of the nozzle is shown in FIG. 7. The nozzle of FIG. 7 is identical to the nozzle of FIGS. 1 and 2, with the exception that the inner circumferential surface at the far downstream end of the housing (denoted 134 in FIG. 2) is not tapered but parallel to the axis of revolution of the housing. The fuel supply passage 110 and the exit orifice 126 are arranged centrally within the housing, the exit orifice 126 being defined by the tubular projecting portion 128. The downstream end surface 132 of the nozzle element and the air exit 124 are arranged radially outwardly with respect to the exit orifice 126. An outer surface of the housing defines surface portions 136 and 138 and a hexagonal nut portion 140.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A nozzle for air-assisted atomization of a liquid fuel, the nozzle comprising a housing and, within the housing:

a fuel feed passage and an air feed passage;

a swirling chamber arranged at a downstream end of the fuel and air feed passage, respectively;

an exit orifice downstream of the swirling chamber through which a cone shaped spray of fuel may emerge out of a nozzle element;

an air bypass passage for leading a fraction of the air flow in the air feed passage past the swirling chamber and to at least one air exit;

wherein the housing forms an inner circumferential surface extending from the air exit to a far downstream end of the housing, the inner circumferential surface extending parallel to a longitudinal axis of the nozzle or being outwardly tapered from the air exit to said far downstream end of the housing;

the exit orifice is arranged downstream of the air exit with the exit orifice being defined by a tubular projecting portion at a downstream surface of the nozzle element, whereby, during operation of the nozzle, air emerging through the air exit reduces depositing of residues of fuel on the downstream surface of the nozzle element.

2. The nozzle according to claim 1, wherein the housing defines an axis of revolution which extends through the exit orifice, the air exit being arranged radially displaced relative to the exit orifice.

3. The nozzle according to claim 1, further comprising means for achieving a rotating flow of air out of the air exit.

4. The nozzle according to claim 1, wherein at least a portion of the air bypass passage is provided in the nozzle element.

5. The nozzle according to claim 1, wherein the air exit is formed as an annular orifice.

6. The nozzle according to claim 1, wherein the air exit is arranged at a location downstream of the swirling chamber.

7. The nozzle according to claim 1, wherein the air exit is provided between a surface of the nozzle element and a surface of the housing.

8. The nozzle according to any claim 1, wherein the housing is outwardly tapered from the air exit to a far downstream end surface of the housing.

9. The nozzle according to claim 2, wherein, in a cross-sectional plane parallel to the axis of revolution, the air bypass passage is substantially parallel to the axis of revolution in the area of the air exit.

10. The nozzle according to claim 2, wherein, in a cross-sectional plane perpendicular to the axis of revolution, at least a portion the air bypass passage is curved.

11. The nozzle according to claim 1, wherein the exit orifice is provided at a downstream end of an exit passage, an upstream end of which is in fluid communication with the swirling chamber.

12. The nozzle according to claim 11, wherein the exit passage is formed as a tubular portion projecting from a downstream surface of the nozzle element.

13. The nozzle according to claim 11, wherein the exit passage is constituted by a central orifice in the nozzle element.

14. The nozzle according to claim 1, wherein the exit orifice is located in a plane defined by a far downstream end surface of the housing.

* * * * *